US008500495B2

(12) United States Patent
Wang et al.

(10) Patent No.: US 8,500,495 B2
(45) Date of Patent: Aug. 6, 2013

(54) ELECTRICAL CONNECTOR HAVING IDENTIFICATION FUNCTION

(75) Inventors: Li-Jiang Wang, Kunshan (CN); Xian-Wei Feng, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/344,599

(22) Filed: Jan. 5, 2012

(65) Prior Publication Data

US 2012/0178284 A1 Jul. 12, 2012

(30) Foreign Application Priority Data

Jan. 6, 2011 (CN) ..... 2011 2 0002557

(51) Int. Cl.
*H01R 24/00* (2006.01)

(52) U.S. Cl.
USPC ..... 439/660; 439/488

(58) Field of Classification Search
USPC ..... 439/660, 488, 491
See application file for complete search history.

(56) References Cited

U.S. PATENT DOCUMENTS 8,308,515 B2 * 11/2012 Chang ..... 439/660
2010/0254660 A1 * 10/2010 Bailey et al. ..... 385/75

* cited by examiner

*Primary Examiner* — Gary F. Paumen
(74) *Attorney, Agent, or Firm* — Wei Te Chung; Ming Chieh Chang

(57) ABSTRACT

An electrical connector (100) includes an insulative housing (1), a set of contacts (3) retained in the insulative housing (1) and a shell (2). The shell (1) has a mating port to mate with a connector. The insulative housing (1) comprises a first body (11) and a second body (12) assembled together. The first body (11) includes a first tongue plate (112), the first tongue plate (112) defines a receiving cavity (1122), the second body (12) is exposed in the mating port and includes a second tongue portion (121). The first tongue plate (112) forms a first identification unit, the second tongue portion (121) forms another identification unit different from the first identification unit. As a result, user can sign if the electrical connector (100) can mate with at least two kinds of connectors.

18 Claims, 8 Drawing Sheets

ELECTRICAL CONNECTOR HAVING IDENTIFICATION FUNCTION

BACKGROUND OF THE INVENTION

1. Field of the Invention

The present invention generally relates to an electrical connector and more particularly to an electrical connector having identification function.

2. Description of Related Art

Chinese patent issue No. 201303173Y, issued on Sep. 2, 2009, discloses a conventional electrical connector including an insulative housing, a plurality of contacts retained in the insulative housing and a shell attached to the housing. The housing includes a first body and a second body mating with the first body. The contacts include a plurality of first contacts retained in the first body and a plurality of second contacts retained in the second body. However, the first body and the second body are made in materials with a same color. The user can not recognize whether the housing is assembled by two bodies or formed in a one-piece in using. As a result, the user can not know whether the connector can be available for one plug or two different plugs. It brings inconvenience to distinguish when the users in using.

It is thus desired to provide an electrical connector having identification function.

SUMMARY OF THE INVENTION

The present invention provides an electrical connector including an insulative housing, a plurality of contacts retained in the insulative housing and a shell attached to the housing defining jointly with the housing an insertion opening for permitting an insertion of a plug therein. The housing comprises a first body and a second body mating with the first body. The first body comprises a first tongue plate exposed in the insertion opening. The first tongue plate comprises a receiving cavity. The second body comprise a second tongue plate exposed in the insertion opening as well. The second tongue plate is received in the receiving cavity. The first tongue plate forms a first identity unit. The second tongue plate forms a second identity unit which is different from the first identity unit.

Other objects, advantages and novel features of the present invention will become more apparent from the following detailed description of the present embodiment when taken in conjunction with the accompanying drawings.

DETAILED DESCRIPTION OF THE INVENTION

Figure 1:
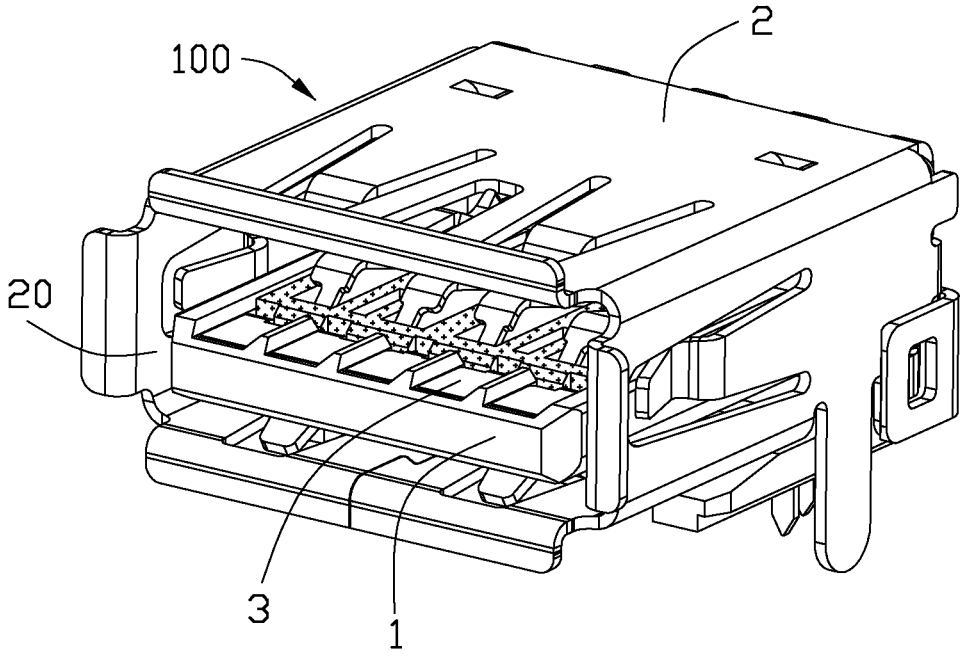
FIG. 1 is an assembled perspective view of an electrical connector according to a preferred embodiment of the present invention.

Reference will now be made to the drawing figures to describe the preferred embodiment of the present invention in detail.

Figure 2:
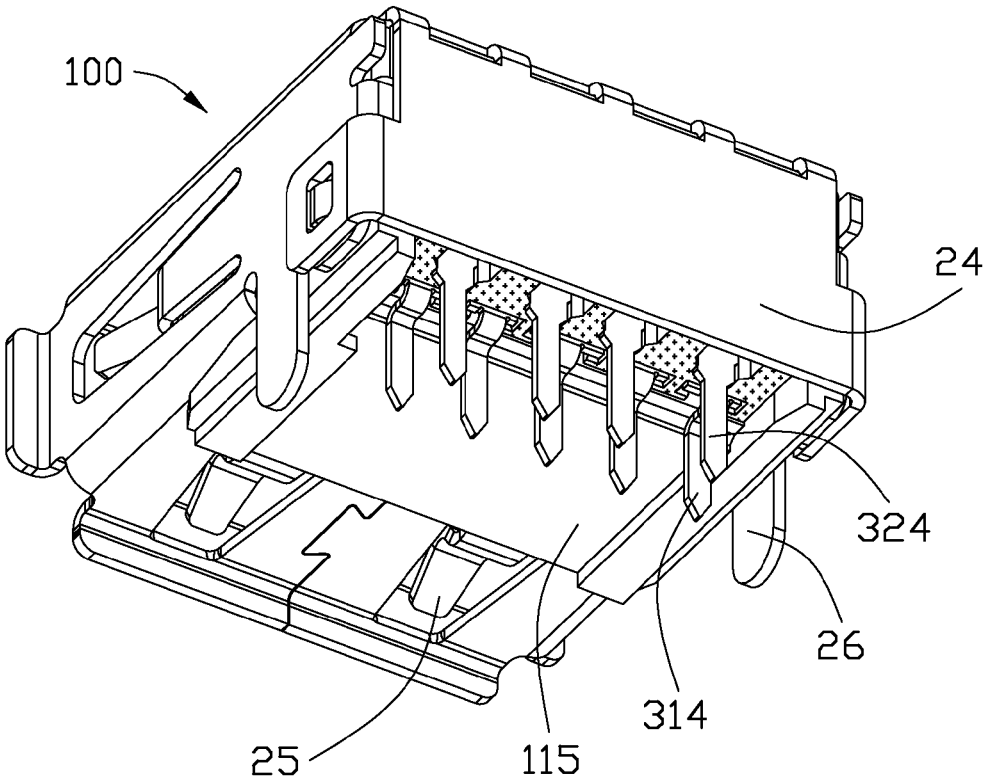
FIG. 2 is another assembled perspective view of the electrical connector as shown in FIG. 1 taken from a bottom side.
Figure 3:
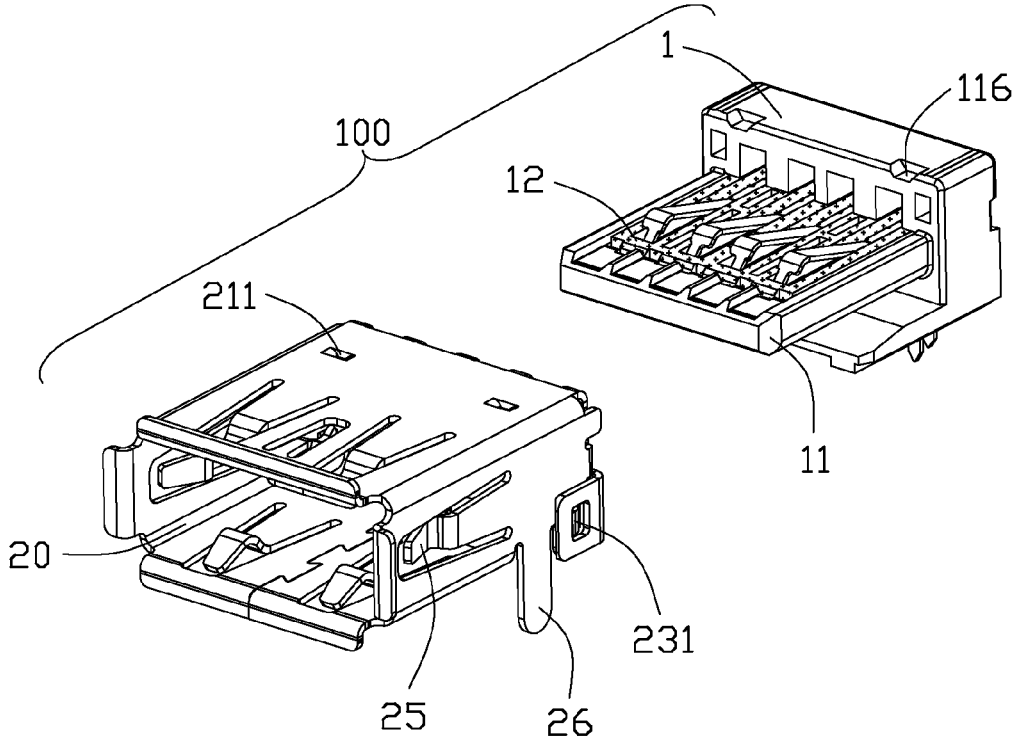
FIG. 3 is a partially exploded perspective view of the electrical connector.
Figure 4:
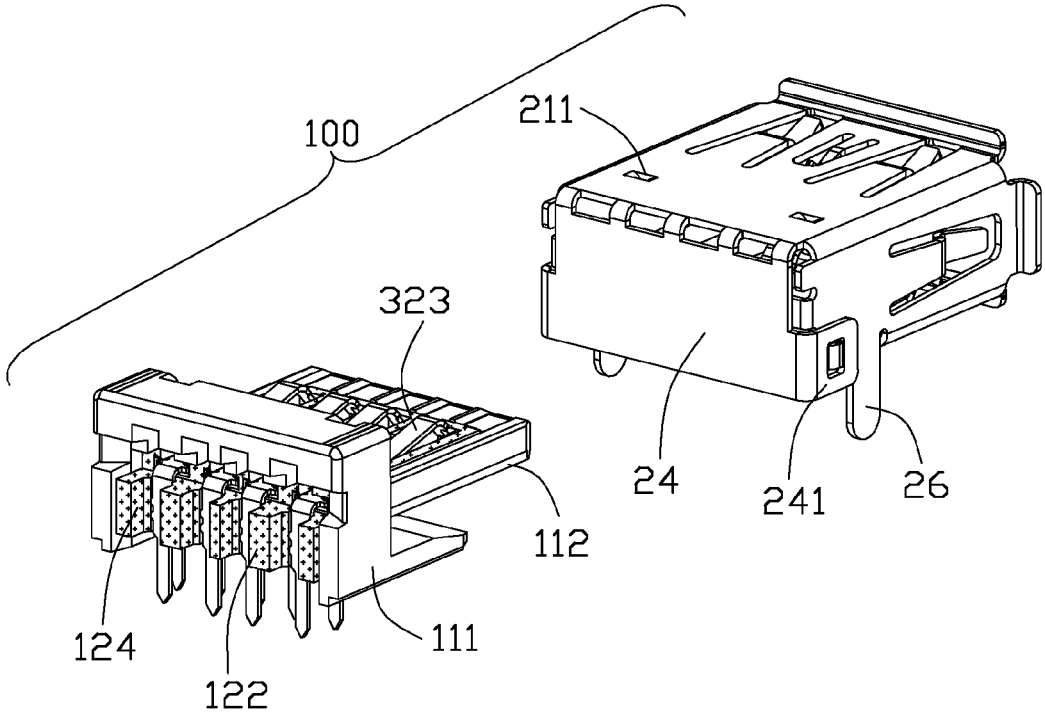
FIG. 4 is another partially exploded perspective view of the electrical connector, while taken from a different aspect.
Figure 5:
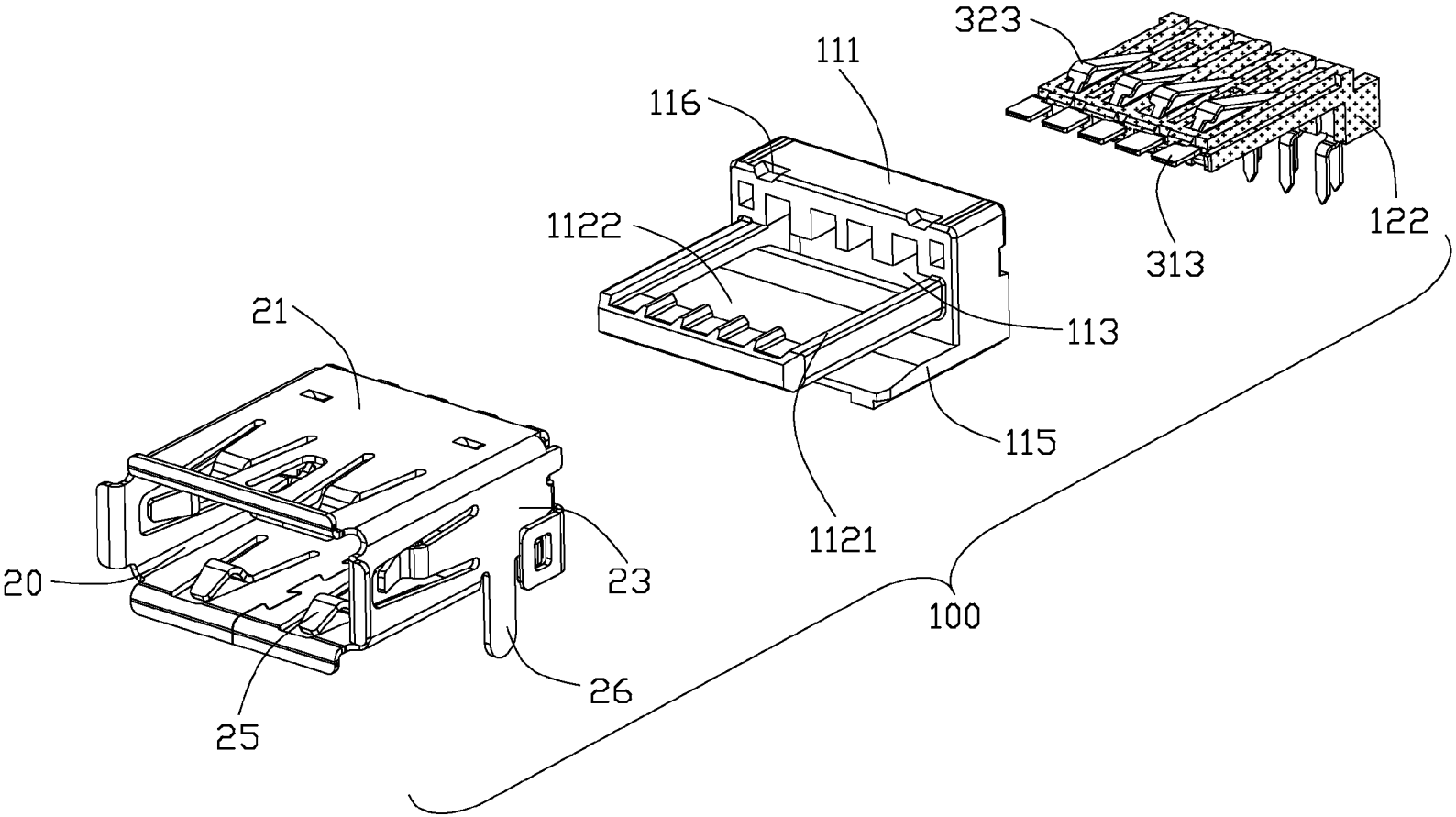
FIG. 5 is a further exploded perspective view of the electrical connector as shown in FIG. 3.
Figure 6:
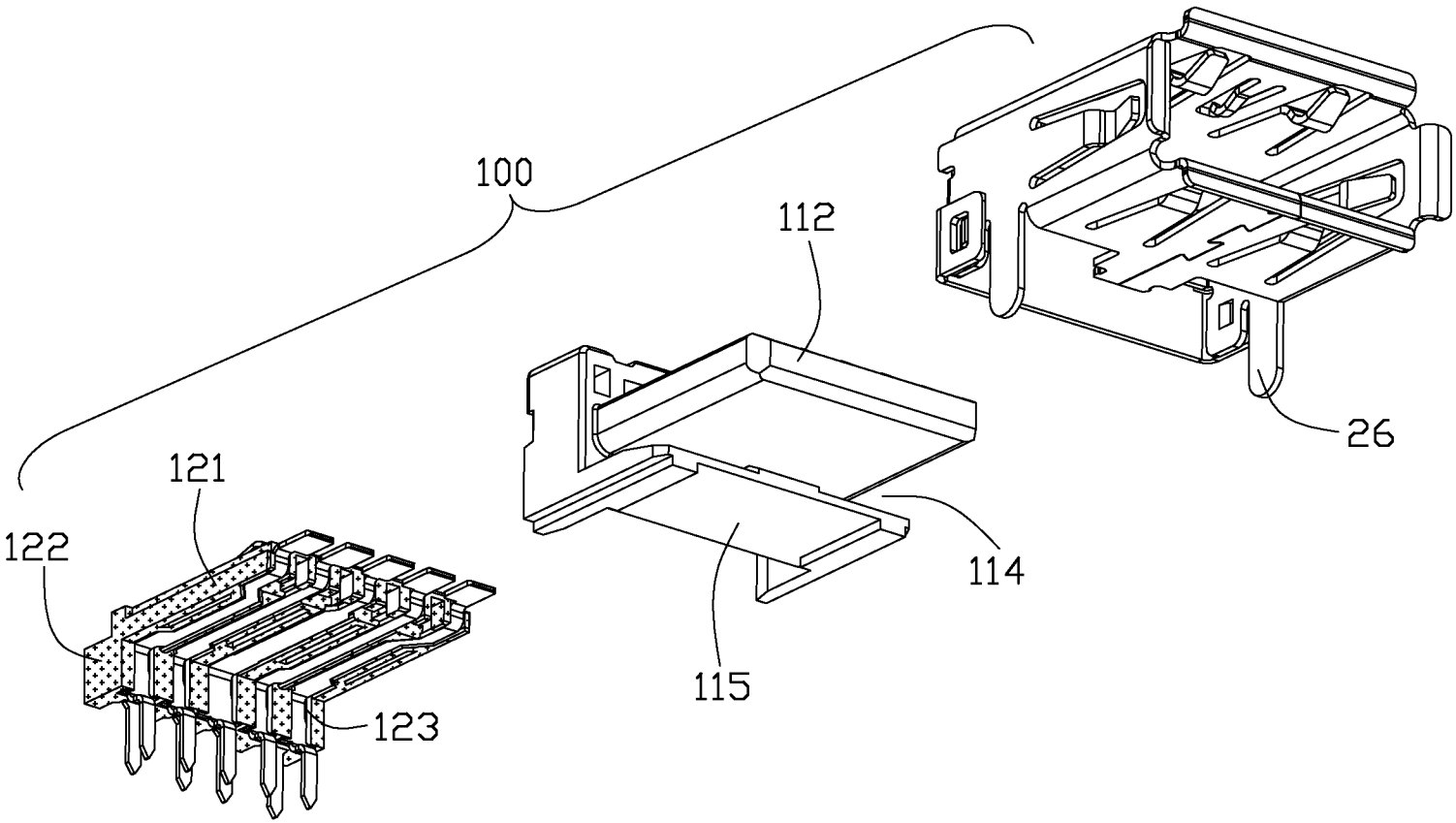
FIG. 6 is similar to FIG. 3, but taken from another aspect.
Figure 7:
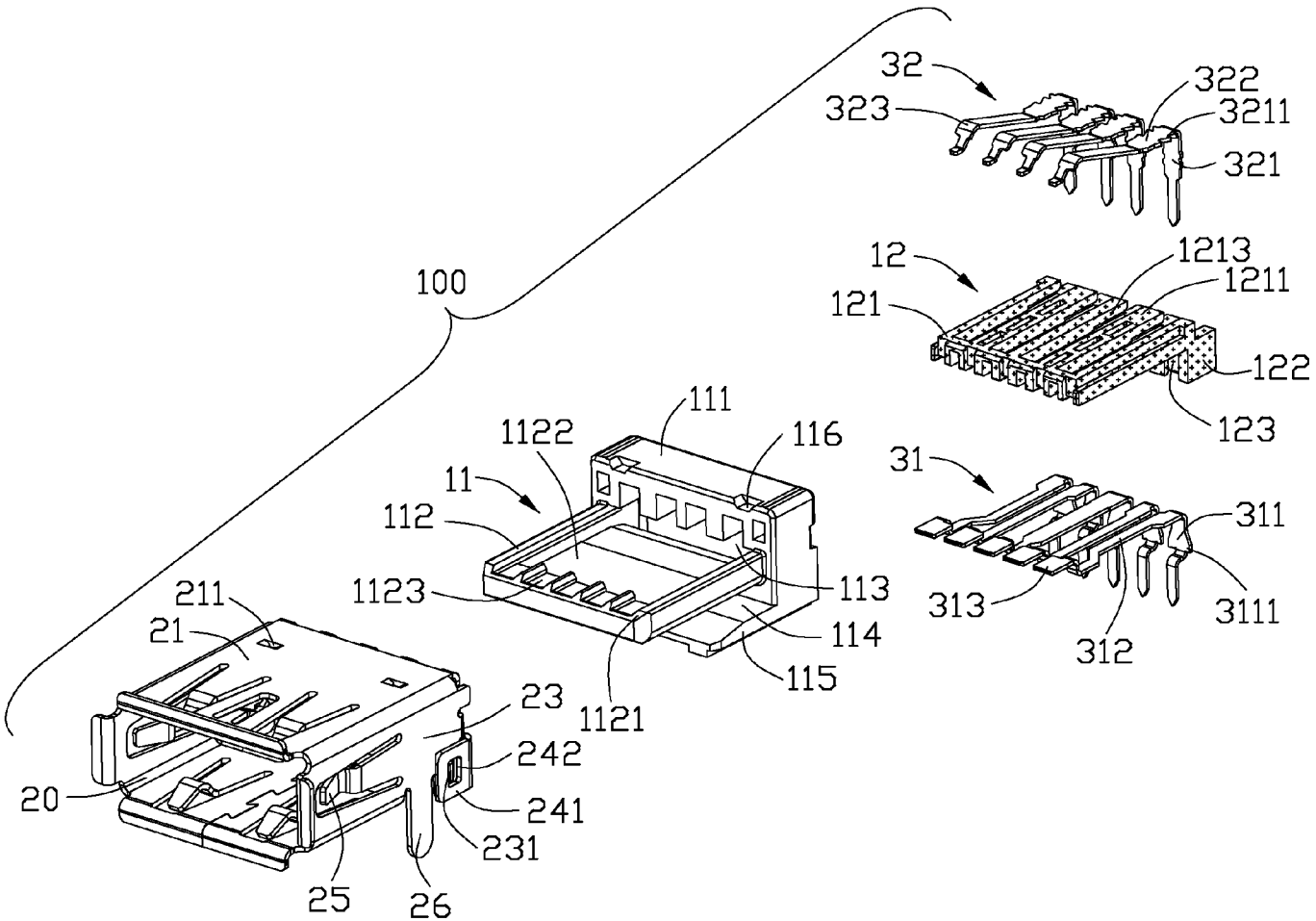
FIG. 7 is an exploded perspective view of the electrical connector.
Figure 8:
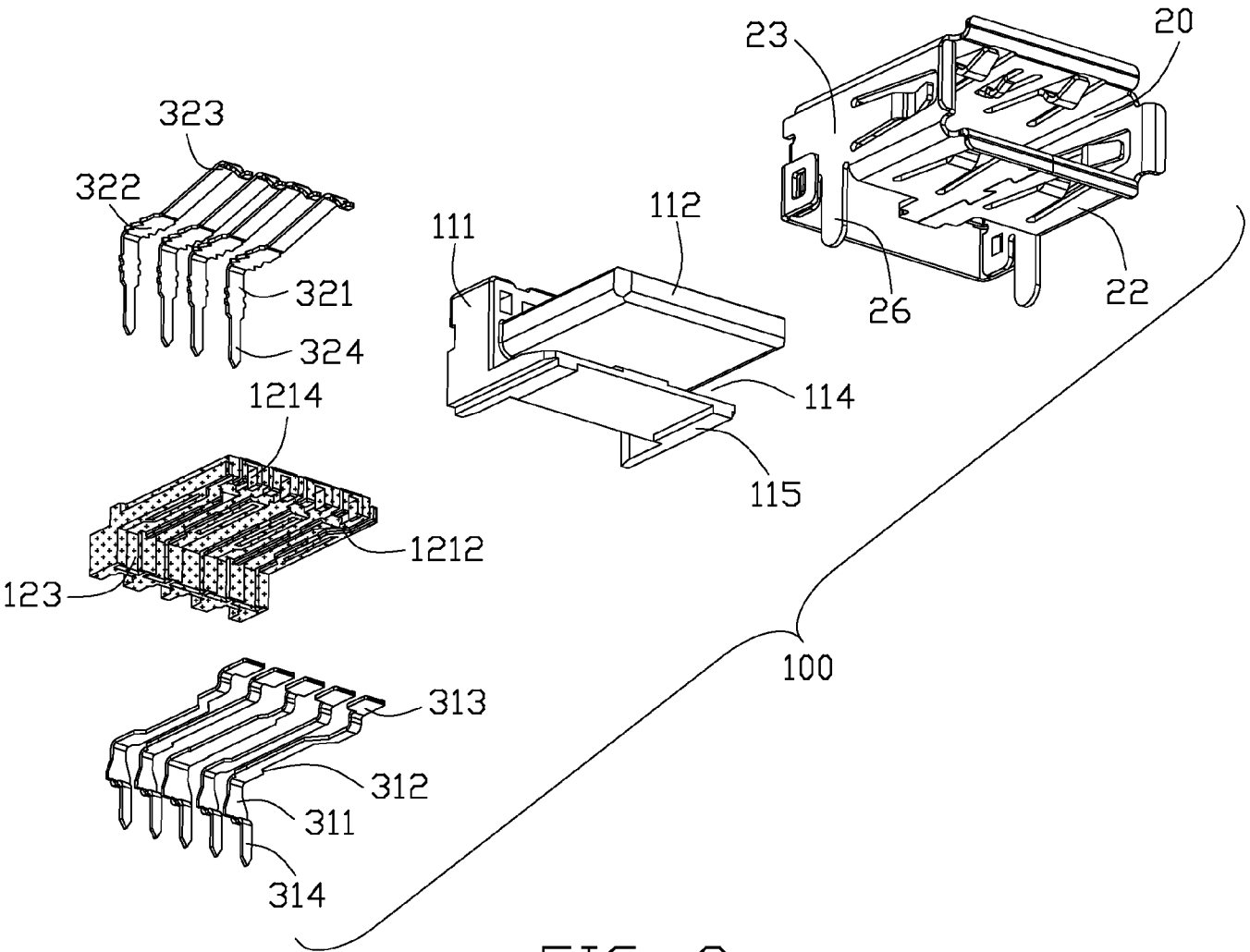
FIG. 8 is similar to FIG. 7, but taken from another aspect.

Referring to FIGS. 1-8, an electrical connector 100 includes an insulative housing 1, a shell 2 substantially enclosing the housing 1 and a plurality of electrical contacts 3 retained in the insulative housing 1.

The insulative housing 1 includes a first body 11 and a second body combined with the first body 11 along a top-to-down direction. The first body 11 and the second body 12 are made in different materials, and the material of the first body 11 is better in characteristics than that of the second body 12. The first body 11 forms a first identity unit, the second body 12 forms a second identity unit which is different from the first identity unit. The first body 11 has a first base portion 111 and a first tongue plate 112 extending forwardly from a middle of the base portion 111. The first base portion 111 defines an opening 113 for receiving the second body 12 and a plate 115 extending forwardly from a bottom of the first base portion 111. A card slot 114 is formed between the plate 115 and the first tongue plate 112. The first base portion 111 also defines a gap 116 on a top thereof to engage with the shell 2. The first tongue plate 112 includes a mating face 1121, a receiving cavity 1122 depressing on the mating face 1121 and a plurality of stationary slots 1123 arranged horizontally in a head edge of the first tongue plate 112.

The second body 12 includes a second tongue portion 121 received in the receiving cavity 1122 and a second base portion 122 received in the opening 113. The second base portion 122 is located in a rear end of the second tongue portion 121. The second base portion 122 defines a plurality of limiting grooves for retaining the electrical contacts 3. The grooves include a plurality of first limiting grooves 123 located in a front side of the second base portion 122 and a plurality of second limiting grooves 124 in a rear side of the second base portion 122. The second tongue portion 121 has an upper surface 1211, a lower surface 1212, a plurality of first receiving grooves 1214 depressing on the lower surface 1212 and a plurality of second contact-receiving grooves 1213 depressing on the upper surface 1211. The first limiting groove 123 communicates with corresponding first receiving groove 1214. The second limiting groove 124 is in communication to corresponding second contact-receiving groove 1213.

The contacts 3 comprise a plurality of first contacts 31 and a plurality of second contacts 32. The first contact 31 has a first retaining portion 311 retained in the first limiting groove 123, a first projecting portion 312 extending forwardly from a top edge of the first retaining portion 311 to be received in the first receiving groove 1214, a first flat contacting portion 313 near a front edge of the first tongue plate 112, which is received in the stationary slot 1123. The first contact 31 still has a first soldering portion 314 extending downwardly from a bottom edge of the first retaining portion 311. The first retaining portion 311 comprises a plurality of first lance sections 3111 for interfering with the first limiting groove 123 to firmly hold the first contact 31. The second contact 32 has a second retaining portion 321 retained in the second limiting groove 124, a second projecting portion 322 extending forwardly from a top edge of the second retaining portion 321 to be received in the second contact-receiving groove 1213, a second elastic contacting portion 323 extending forwardly and horizontally and a second soldering portion 324 extending downwardly from a bottom edge of the second retaining portion 321. The second retaining portion 321 and the second projecting portion 322 comprise a number of second lance sections 3211 for engaging with the second limiting groove 124 and the second contact-receiving cavity 1213 to firmly hold the second contact 32 on the second body 12.

The shell 2 includes an insertion opening 20 for inserting a complementary connector, a top wall 21 facing the first tongue plate 11, a bottom wall 22 corresponding with the top wall 21, a pair of sidewalls 23 connecting the top wall 21 and the bottom wall 22, and a rear wall 24 extending downwardly from a back end of the top wall 21. In this embodiment, the top wall 21 comprises a plurality of embosses 211 engaging with the gap 116, so that, the shell 2 can be retained within the housing 1 without relative movement to the housing 1. The top wall 21, the bottom wall 22 and the side walls 23 all include a plurality of spring tabs 25 extending inwardly to the insertion opening 20. The side wall 23 has a pair of mounting legs 26 extending downwardly beyond the bottom wall 22. The rear wall 24 comprises a pair of retaining tabs 241 extending forwardly from both sides of the rear wall 24. The retaining tab 241 defines some locking holes 242 locking with some protrusions 231 formed on the side wall 23.

In assembly, firstly, the second contacts 32 are assembled to the second body 12. The second retaining portion 321 is retained in the second limiting groove 124 via the second lance section 3211 engaging with the limiting groove 124. The second soldering portion 324 extends downwardly beyond the bottom wall 22 for soldering on a corresponding printed circuit board. The second projecting portion 322 is retained in the second contact-receiving groove 1213 by means of the second lance section 3211 engaging with the second contact-receiving groove 1213. The second elastic contacting portions 323 are aligned along a transverse direction of the second tongue plate 121 and extending beyond the upper surface 1211 thereof, the resilient free end of the second elastic contacting portion 323 is retained in the second body 12.

Secondly, the first contacts 31 are assembled to the second body 12. The first retaining portion 311 is retained in the first limiting groove 123 by the first lance section 3111 engaging with the first limiting groove 123, the first soldering portion 314 extends downwardly beyond the bottom wall 22 for soldering on a corresponding printed circuit board. The first projecting portion 312 is received in the first receiving groove 1214. The flat contacting portions 313 catileverdly extending beyond a front surface of the second body 12. The first contacts 31 and the second contacts 32 are located on the upper and the lower sides of the second tongue plate 121.

Successively, when the first and the second contacts 31, 32 have been assembled with the second body 12, the second body 12 is installed into the first body 11 from back to front through the opening 113. The first projecting portion 312 is located stationary between the first and the second tongue plate 112, 121 by means of the first tongue plate 112 upwardly engaging with the second tongue plate 121. The flat contacting portions 313 are received and fixed in the stationary slots 1123 while the second elastic contacting portions 323 are deformable in the contact-receiving grooves 1213 and are higher than the first flat contacting portions 313.

Finally, the first body 11 combined with the second body 12 are installed forwardly into an inner side of the shell 2 from the back to front. The slot 114 holds forwardly both sides of the bottom wall 22. The embosses 211 of the top wall 21 protrude into the gaps 116 of the first body 11 to prevent the first body 11 from further moving forwardly. Then flip down the rear wall 24 to make the retaining tab 241 split with the protrusion 231 for making the insulative housing 1 be fixed with the shell 2. When in using, the user can recognize different colors of the first tongue plate 112 and the second tongue plate 121, so they will know that the connector can be docked two kind of complementary connectors.

To form two kind of identity units, the connector 100 of this invention also can past different color labels on the first and second tongue plates 112, 121 (such as black and blue) respectively; or coat a region of one of the first and the second tongue plate 112,121 with fluorescent powder or pigment thereon; or set light sources of different glosses inside in the first tongue plate 112 and the second tongue plate 121 respectively; or set different pattern on the first and the second tongue plates 121,112 respectively; above four other embodiments as described above can also achieve the proposal of the connector 100 of this invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing comprising a first body and a second body mating with the first body;

a plurality of contacts retained in the insulative housing; and a shell attached to the insulative housing to jointly define an insertion opening for an insertion of a plug; wherein the first body has a first tongue plate exposed in the insertion opening and defining a receiving cavity, the second body is formed with a second tongue plate received in the receiving cavity and exposed in the insertion opening as well, the first tongue plate is marked by a kind of color to form a first identity unit, and the second tongue plate is marked by another kind of color to form a second identity unit which is different from the first identity unit.

2. The electrical connector as claimed in claim 1, wherein the first tongue plate and the second tongue plate are made of different materials, and the material of the first tongue plate is stronger than that of the second tongue plate.

3. The electrical connector as claimed in claim 2, wherein the shell comprises a top wall facing the receiving cavity, a bottom wall corresponding to the top wall and a pair of side walls, and the side wall comprises a pair of mounting legs extending downwardly beyond the bottom wall, the bottom wall and the second tongue plate are located on both sides of the first tongue plate.

4. The electrical connector as claimed in claim 3, wherein the second body has a base portion, and a plurality of limiting grooves are defined on the base portion for retaining the contacts.

5. The electrical connector as claimed in claim 4, wherein the limiting grooves include a plurality of first and second limiting grooves, the first limiting groove is located in a front side of the base portion and the second limiting groove is located in a back side of the base portion, the contacts comprise a plurality of first contacts and a plurality of second contacts, the first contact has a first retaining portion retained in the first limiting groove, the second contact has a second retaining portion retained in the second limiting groove.

6. The electrical connector as claimed in claim 5, wherein the second tongue plate defines a receiving groove communicating with the first limiting groove on a side thereof, the first contact comprises a first projecting portion received in the first receiving groove and a first flat contacting portion, the first projecting portion extends forwardly from the first retaining portion and the first contacting portion further extends forwardly from the first projection, the first tongue plate defines a plurality of stationary slots for receiving the first contacting portions.

7. The electrical connector as claimed in claim 5, wherein a second receiving groove is formed on a side of the second tongue plate facing the top wall, the second contact has a second elastic contacting portion received in the second receiving groove and further extending forwardly from the second retaining portion.

8. The electrical connector as claimed in claim 4, wherein the first body further comprises another base portion, the another base portion defines an opening communicating with the receiving cavity for receiving the base portion of the second body.

9. The electrical connector as claimed in claim 5, wherein the receiving cavity is recessed in a top side of the first tongue plate facing the top wall, the first contact and the second contact comprise a first soldering portion and a second soldering portion, respectively, extending downwardly beyond the bottom wall.

10. An electrical connector comprising:

a shell;

an insulative housing enclosed by the shell and comprising a first body and a second body separately made but assembled with the first body, the first body defining a receiving cavity to receive the second body and a plurality of stationary slots in communication with the receiving cavity, the second body comprising an upper surface and a plurality of contact-receiving grooves recessed from the upper surface, the first body and the second body being made of materials of different colors;

a plurality of contacts retained in the second body, the contacts having a first kind of contact each formed with a flat contacting portion catileveredly extending beyond a front surface of the second body, and a second kind of contact each formed with an elastic contacting portion extending beyond the upper surface of the second body, the flat contacting portions received and fixed in the stationary slots while the elastic contacting portions are deformable in the contact-receiving grooves and are higher than the flat contacting portions.

11. The electrical connector as claimed in claim 10, wherein the shell defines an insertion opening for permitting an insertion of a plug therein, the first body comprises a first tongue plate exposed in the insertion opening, the receiving cavity depressed on the first tongue plate, the second body comprises a second tongue plate received in the receiving cavity and also exposed in the insertion opening.

12. The electrical connector as claimed in claim 11, wherein the first tongue plate and the second tongue plate are made of different materials, and the material of the first tongue plate is strong than that of the second tongue plate.

13. The electrical connector as claimed in claim 11, wherein the shell comprises a top wall facing the receiving cavity, a bottom wall corresponding to the top wall and a pair of side walls, the side wall comprises a pair of mounting legs extending downwardly beyond the bottom wall, the bottom wall and the second tongue plate are located on both side of the first tongue plate.

14. The electrical connector as claimed in claim 13, wherein the second body comprises a base portion, a plurality limiting grooves are depressed on the base portion for retaining the contacts.

15. The electrical connector as claimed in claim 14, wherein the limiting grooves include a plurality of first and second limiting grooves, the first limiting groove is located in front side of the base portion and the second limiting groove is located in back side of the base portion, the contacts comprise a plurality of first contacts and a plurality of second contacts, the first contact comprises a first retaining portion retained in the first limiting groove, the second contact comprises a second retaining portion retained in the second limiting groove.

16. The electrical connector as claimed in claim 15, wherein the receiving cavity is recessed in a top side of the first tongue plate facing the top wall, the first contact and the second contact comprise a first soldering portion and a second soldering portion, respectively, extending downwardly beyond the bottom wall.

17. An electrical connector comprising:

an insulative housing defining a mating tongue having opposite first and second surfaces in a vertical direction;

a plurality of first contacts disposed in the housing with first contacting sections exposed upon the first surface;

a plurality of second contacts disposed in the housing with second contacting sections exposed upon the first surface wherein said first contacting sections and said second contacting sections are essentially offset from each other in a front-to-back direction perpendicular to said vertical direction, and the first contacting sections are moveable in the vertical direction while the second contacting sections are immoveable in the vertical direction; wherein a portion of the mating tongue, which is associated and neighbored with the first contacting sections, has the capability of being seen as different and discrete, without possibility of unity, from another portion of the mating tongue which is associated and neighbored with the second contacting sections, for differentiation of functions of the first contacts and the second contacts; wherein said capability of being seen as different and discrete is derived from color difference or material difference.

18. The electrical connector as claimed in claim 17, wherein said portion and said another portion are overlapped with each other in the front-to-back direction, the vertical direction and a transverse direction perpendicular to both said front-to-back direction and said vertical direction.

* * * * *